US008910348B2

(12) United States Patent
Schenk

(10) Patent No.: US 8,910,348 B2
(45) Date of Patent: Dec. 16, 2014

(54) BRACELET LATCH HAVING AN EXTENSIBLE BUCKLE

(75) Inventor: Bernard Schenk, St-Imier (CH)

(73) Assignee: Arcofil S.A., St-Imier (CH)

( * ) Notice: Subject to any disclaimer, the term of this patent is extended or adjusted under 35 U.S.C. 154(b) by 25 days.

(21) Appl. No.: 13/576,266

(22) PCT Filed: Dec. 14, 2010

(86) PCT No.: PCT/EP2010/069662

§ 371 (c)(1),
(2), (4) Date: Jul. 31, 2012

(87) PCT Pub. No.: WO2011/095248

PCT Pub. Date: Aug. 11, 2011

(65) Prior Publication Data

US 2012/0297592 A1 Nov. 29, 2012

(30) Foreign Application Priority Data

Feb. 4, 2010 (CH) ..... 0139/10

(51) Int. Cl.
*A44C 5/24* (2006.01)

(52) U.S. Cl.
CPC ..... *A44C 5/246* (2013.01)
USPC ..... 24/71 J; 63/3.2

(58) Field of Classification Search
USPC ..... 24/70 J, 69 J, 68 J, 71 R, 71 ST, 71 J, 24/71 SK, 265 WS, 265 EC; 63/3.2, 5.1, 63/7–9
See application file for complete search history.

(56) References Cited

U.S. PATENT DOCUMENTS 1,817,475 A * 8/1931 Becker ..... 224/176
2,065,581 A 12/1936 Heileman
2,069,559 A * 2/1937 Ritter ..... 24/71 J (Continued)

FOREIGN PATENT DOCUMENTS

CN 1145434 C 4/2004
CN 101677658 A 3/2010

(Continued)

OTHER PUBLICATIONS

International Search Report, dated May 6, 2011, from corresponding PCT application.

(Continued)

*Primary Examiner* — Victor Batson
*Assistant Examiner* — Abigail Morrell
(74) *Attorney, Agent, or Firm* — Young & Thompson

(57) ABSTRACT

A latch for a bracelet having an extensible buckle, includes a cap defining a recess and including a slide in which a slider is engaged, the slider being intended for connecting the cap (10) to a bracelet strand using first hinge elements (18). The slider includes at least first (16) and second (17) segments connected together by second hinge elements (20). The segments (16, 17) are folded into the recess when the latch buckle is not extended. The latch (1) further includes slider indexing elements provided in the cap so that the slider can assume a sequence of fixed positions relative to the cap, between a first and second end position. In the first end position, the slider is located in the recess such that the ends (14*a*, 14*b*) of the latch are at a minimal distance. In the second end position, the slider is located essentially outside the recess.

9 Claims, 6 Drawing Sheets

(56) References Cited

U.S. PATENT DOCUMENTS

| | | | | | |
|---|---|---|---|---|---|
| 2,097,055 | A | | 10/1937 | Bender | |
| 2,159,079 | A | * | 5/1939 | Goulden | 24/71 J |
| 2,190,878 | A | * | 2/1940 | Lundman | 24/71 J |
| 5,689,859 | A | | 11/1997 | Cuche | |
| 5,749,128 | A | * | 5/1998 | Cuche | 24/71 J |
| 5,787,554 | A | | 8/1998 | Hashimoto | |
| 7,926,150 | B2 | | 4/2011 | Robert et al. | |
| 2007/0125123 | A1 | | 6/2007 | Sierro | |

FOREIGN PATENT DOCUMENTS

| | | | |
|---|---|---|---|
| EP | 0748597 | A1 | 12/1996 |
| EP | 1 378 185 | A1 | 1/2004 |
| JP | H09327308 | A | 12/1997 |

OTHER PUBLICATIONS

Translation of Chinese Office Action, dated Jan. 14, 2014, from corresponding CN application.

* cited by examiner

BRACELET LATCH HAVING AN EXTENSIBLE BUCKLE

TECHNICAL FIELD

The present invention relates to the field of bracelets, in particular for watches. It more particularly relates to a bracelet latch having an extensible buckle whereof the length can be modified by the user.

BACKGROUND OF THE INVENTION

Latches with extensible buckles are well known, in particular for their esthetic appearance. They have the drawback, however, of not being able to be adjusted easily to adapt the length of the bracelet to the wearer's wrist.

Many solutions have been proposed to allow the user to adjust the latch himself, in particular without using tools.

For example, U.S. Pat. No. 2,097,055 describes a latch comprising three articulated segments, connected to a central blade. One of the segments can slide into the central blade to be placed in a series of slots determining the length of the bracelet.

Another example is described in patent application EP 1 378 185A1. The end of one of the strands of the bracelet is attached to an organ capable of sliding in a slot formed in the latch so as to make it possible to adjust the length of the bracelet. The sliding of this organ is allowed by two push-pieces equipped with hooks that engage in the mobile organ.

Each of these latches has a locking organ for locking the latch and a separate organ for adjusting the length of the bracelet.

Document US 2065581 proposes an interesting system, in which the articulated segments forming the latch are able to be placed in a housing formed by the cap of the latch. In one of the embodiments described, a second sliding element can also slide in the housing, on the side opposite the first element.

The first sliding element consists of three extensible blades, which can be placed in the housing when they are folded. To index the position of the sliding element, slots are formed in the sliding element and can cooperate with slots formed in the cap or in the second sliding element. To lock the position of the sliding element(s), a lever is pivotably mounted in the cap, and makes it possible to actuate a cam acting on an elastic blade. The pressure exerted by the latter part when it is deformed under the action of the cam makes it possible to engage the slots in one another to secure the position of the sliding elements.

The lever therefore only serves as a locking organ for the bracelet and, when the latch is unlocked, the bracelet will tend to open completely under the weight of the watch. Thus, in the event of untimely unlocking, there is a risk of the latch opening and the watch falling. Furthermore, it may also be noted that the ergonomics of such a system are not optimal, since to close the latch, it is necessary to keep the sliding elements in the desired position and simultaneously actuate the lever, these operations naturally having to be done with one hand. Lastly, when it is in the open position, the sliding elements are no longer indexed, the slots not being engaged in one another and no longer being across from one another. Also, in light of the large number of proposed notches, the previous adjustment position is not automatically found when the latch is closed again.

One of the aims of the present invention is to provide an improved version of a bracelet latch making it easier to adjust the length of the bracelet. One of the aims sought by the device according to the invention is in particular to allow a subtle adjustment of the length of the bracelet, so as to impart comfort to the user when, depending on the time of day, the temperature, or the user's activity, the user's wrist swells or contracts, causing compression or play in his watch bracelet.

One additional aim of the invention is to allow the wearer of the watch to adjust the length of the bracelet easily while the latch remains closed.

BRIEF DESCRIPTION OF THE INVENTION

To that end, and according to the present invention, a bracelet latch is proposed with an extensible buckle comprising a cap defining a housing and having a slide-way in which a slide is engaged. The slide is designed to be connected to the strand of a bracelet by a first articulation means. This slide includes at least first and second segments connected to one another by a second articulation means, said segments being at least partially folded in the housing when the buckle of the latch is not extended.

The latch also includes an indexing means for indexing the slide in the cap such that the slide, in reference to the cap, is capable of occupying a discrete series of indexed positions comprised between:

- a first extreme position in which the slide is situated in the housing such that the ends (14*a*, 14*b*) of the latch are at a minimum distance, and
- a second extreme position where the slide is essentially situated outside the housing.

The slide is kept folded in the housing by the cap in all positions, except the second extreme position, in which the segments of the slide can be extended and can bring the ends of the latch to a maximum distance.

Advantageously, the indexing means includes an actuator, a maintenance device for locking the different indexed positions.

According to the invention, the actuator is arranged to transmit a force making it possible both to release the maintenance device so as to unblock the indexed position, and to move the slide relative to the slide-way.

BRIEF DESCRIPTION OF THE DRAWINGS

Other features of the present invention will appear more clearly upon reading the following description, done in reference to the appended drawings, in which.

DETAILED DESCRIPTION OF THE INVENTION

Figure 1:
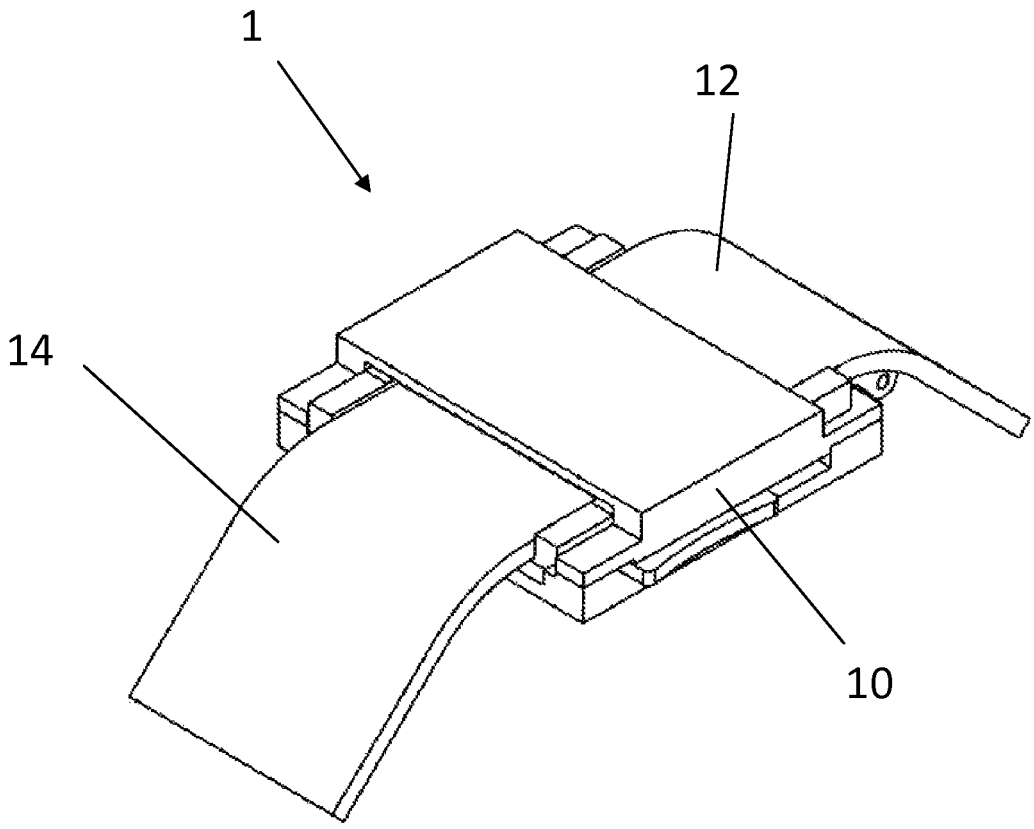
FIG. 1 is a general view of the latch in the nested position.

As illustrated in FIG. 1, the latch according to the invention is of the type comprising a cap 10, visually separating two strands 12, 14 of a bracelet, when the latch is in the closed position. The two strands 12, 14 are each positioned at one end of the latch 14*a*, 14*b*, as better shown in FIG. 2. In this type of latch, the cap 10 defines a housing inside which certain elements of the buckle, which will be described later, fold when the latch is in the closed position. Typically, the latch has a rectangular section.

Figure 2:
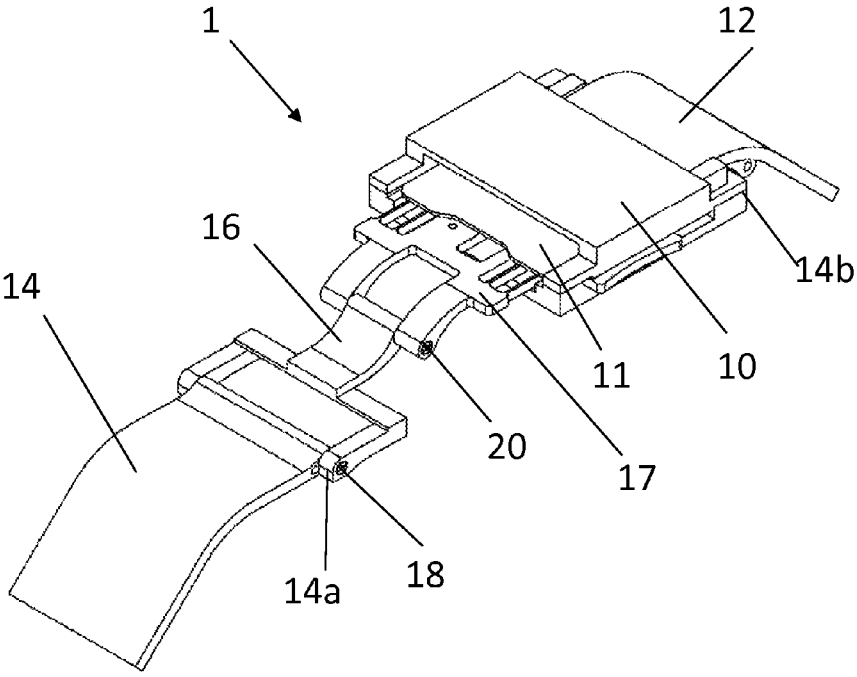
FIG. 2 is a general view of the latch in the extended position according to a first embodiment.

FIG. 2 shows a view in which the buckle of the bracelet is extended. Thus, the ends of the latch 14*a*, 14*b* are at a maximum distance. The assembly formed by the bracelet and the buckle is therefore at its maximum length, such that it is easy for the wearer of the watch to pass it around the wrist or to remove it.

FIG. 2 provides the details of the elements of the latch folded in the housing in FIG. 1. As shown, the first end 14*a* of the latch 1 is connected to a first segment 16 of the latch by a first articulation means 18. This articulation means is generally made by a bar cooperating with openings formed at the end of the bracelet and the latch, to form a hinge.

The first segment 16 is in turn connected to a second segment 17 by a second articulation means 20, which is generally of the same type as the first.

These first and second articulation means 18, 20 allow said articulated structure to fold in a Z, so as to occupy the housing of the latch 1 as indicated in FIG. 1.

Particularly to the invention, the articulated structure previously described is translationally mobile inside the housing of the latch 1 when the segments are folded. It thus forms a slide movably mounted in the cap 10, which is in turn arranged to form a slide.

According to one important aspect of the invention, the slide-way can move between first and second extreme positions relative to the cap:

- a first extreme position, illustrated in FIG. 1, where the slide is located in the housing so that the ends 14*a*, 14*b* of the latch are at a minimum distance, and
- a second extreme position, illustrated by FIG. 2, where the slide is essentially situated outside the housing, so that the segments of the slide can extend and bring the ends 14*a*, 14*b* of the latch to a maximum distance.

Advantageously and as will be better understood hereafter, in particular in reference to FIG. 5, the slide is kept folded in the housing by the cap in all positions, except in the second extreme position.

Thus, one advantageous technical effect of the latch according to the invention is to combine the adjustment of the length of the bracelet and the locking/unlocking of the buckle. In fact, given that the cap prevents the slide from extending, except in the second extreme position, the latch is locked and the length is adjusted from the first extreme position to the position preceding the second extreme position. The unlocking and extension of the bracelet are only obtained in this second extreme position.

In order both to maintain the length of the latch and guarantee the locking of the latch, the slide moves between its two extreme positions, occupying a series of fixed indexed positions, defined by indexing means for indexing the slide in the cap 10.

Figure 3:
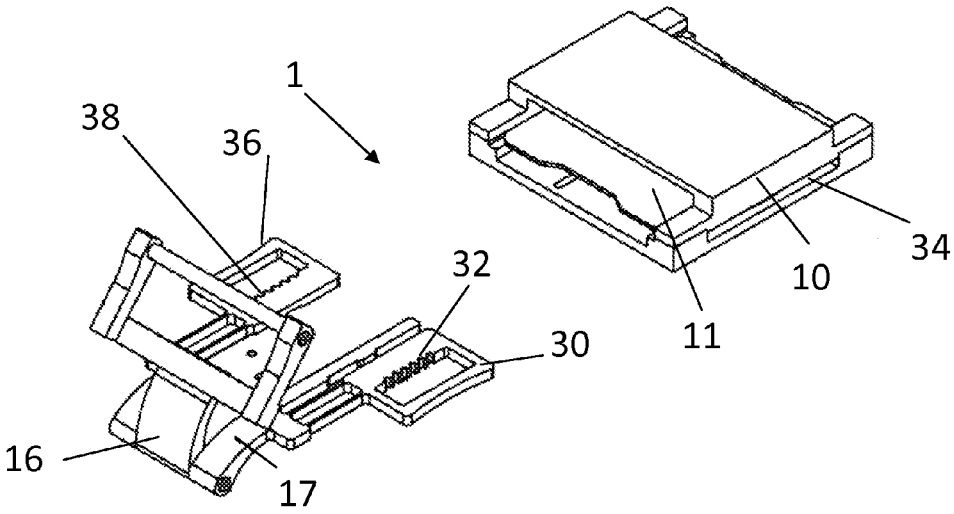
FIG. 3 is an exploded view of the latch according to the first embodiment.

FIG. 3 shows a partially exploded view of the indexing means according to the example. They comprise an actuator 30 on the one hand and a maintenance device making it possible to block the different indexed positions on the other hand. This maintenance device can comprise a notching 32 securely positioned on the second segment 17 of the slide and an indexing finger 81. This notching can assume the form of a toothing formed on a wall of the actuator 30. The notching is preferably regular and defines the series of the fixed positions of the slide, as well as the two extreme positions. The indexing finger 81 is arranged in the cap 10 and visible in FIGS. 6 and 7. The indexing finger 81 is configured so as to cooperate with the notching, to occupy a stable position by cooperating with each of the notches and thus maintain the different indexed positions.

The actuator 30 is movably mounted through a slot 34 formed on a side surface of the cap 10. The length of the slot is adapted to the travel of the slide defined by the two extreme positions. The cap and the slot 34 make it possible to obtain an elegant exterior of the device while giving it a certain discretion combined with ease of manipulation.

In the embodiment illustrated in the drawing, the actuator 30 is secured to the notching 32. The two elements are elastically connected to the slide. The indexing finger 81 cooperates with the notching 32 so as to block the slide in the slide-way when the actuator 30 is at rest. Conversely, when the wearer of the watch actuates the actuator, he makes the notching 32 disengage from the indexing finger so that the slide can be moved freely in the slide-way, through ad hoc pulling exerted on the latch or the bracelet.

Alternatively, one skilled in the art could consider an inverse construction, having the actuator and the indexing finger elastically connected to the slide. The notching would be secured to the cap so that the indexing finger cooperates with the notching so as to block the slide in the slide-way when the actuator is at rest.

The actuator 30 has been shown in the form of a push-piece. One skilled in the art could also use other types of actuators, in particular a more evolved lever or push-piece, with a specific return organ. In particular, a lever could be rotatably mounted on the cap 10. Rotating the lever allows the indexing finger to go between a position in which it cooperates with the notching and a position in which it leaves it free. The return to the "maintenance" position, i.e. in which the notch and the finger cooperate, is done by means of the electrical connection between the actuator and the slide.

Thus, it can be noted that, advantageously, the actuator 30 makes it possible both to free the maintenance device so as to unblock the indexed position, and to move the slide relative to the slide-way. In fact, it is indeed by actuating the actuator, i.e. through a voluntary action, that the user moves the slide. Given that the maintenance device must be kept in the "free" position so that the indexing finger is free relative to the notching and to unblock the indexed position, the user exerts a continuous action on the actuator, preventing the slide from moving other than through the action of the user. Once the user ceases to exert an action on the actuator, the maintenance device would practically instantaneously block the slide in one of the immediately adjacent indexed positions.

FIG. 3 also shows a means for securing the manipulation so as to avoid untimely opening of the buckle in case of impact, for example, on the actuator.

This aim is achieved by doubling the indexing means on the slide. This means being separate, it therefore requires a distinct and simultaneous action on each actuator to free the slide. Thus, FIG. 3 has a second indexing means comprising a second actuator 36 and a second maintenance device. The latter has a second notching 38 arranged on the second segment 17 of the slide and a second indexing finger (not visible in the figure) arranged on the cap. The latter is also provided with a second slot (not visible in the figure), formed on a surface of the cap 10 opposite the first slot. In the example, the two actuators are of the push-piece type. This arrangement allows the wearer of the watch to grasp the actuators with two fingers, i.e. in the example, between the thumb and the index finger, so as to act simultaneously on each actuator and to deliberately slip the slide into its housing completely securely.

Figure 4:
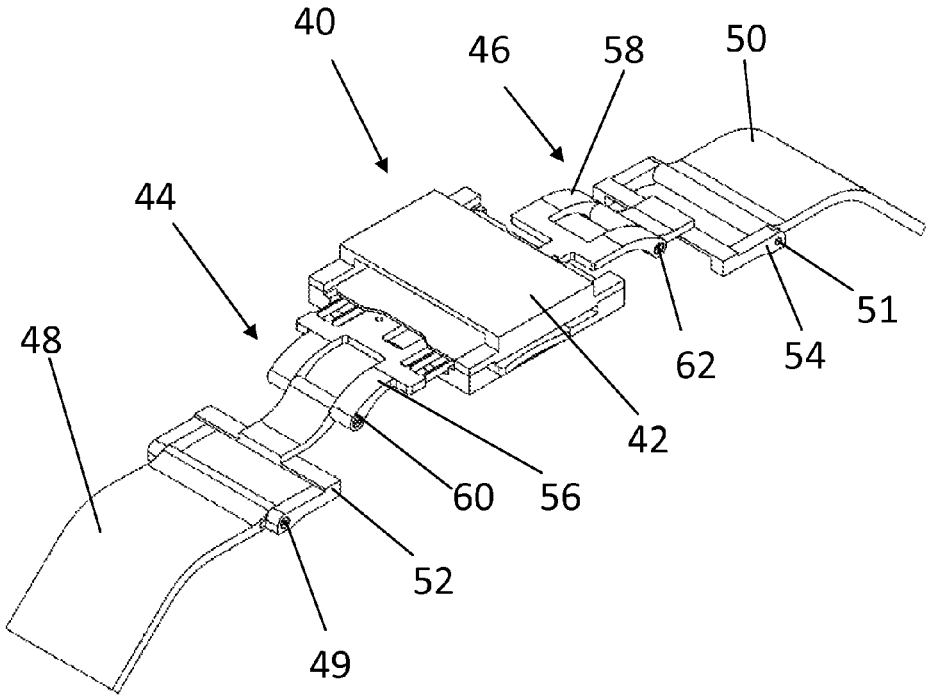
FIG. 4 is a general view of the latch in the extended position according to a second embodiment.

FIG. 4 shows one preferred embodiment of the latch. This is a latch 40 with a so-called "butterfly" structure having a structural symmetry in the segments of the latch and thereby doubling the travel of the adjustment of the bracelet while giving it a remarkable esthetic effect.

More specifically, and according to the present invention, the bracelet latch 40 with an extensible buckle has a cap 42 defining first and second housings and having first and second slide-ways in which first and second slides 44, 46 are respectively engaged. The second housing can also be in the extension of the first housing, thereby forming a single and same housing.

Like what was previously described, the slide-ways are intended to connect the cap 42 to the first and second strands 48, 50 of the bracelet by a first articulation means 49, 51. According to the example, the slide-ways each comprise first 52, 54 and second 56, 58 segments connected to one another by second articulation means 60, 62.

The segments 52, 54, 56, 58 are folded in their respective housings when the buckle of the latch is nested.

The latch also comprises an indexing means for each slide 44, 46 in the cap 42, as described above. Thus, each slide 44, 46 can occupy a series of discrete fixed positions, in reference to the cap, comprised between first and second extreme positions.

FIGS. 5*a*, 5*b*, 5*c* and 5*d* have, in a longitudinal cross-sectional plane, a kinematic decomposition between these extreme positions. Thus, the adjustment of the length of the locked bracelet to the point of extension of the buckle when the bracelet is unlocked is explained in the figures. It will be noted that the respective movements of the slides can be done independently of one another.

Figure 5A:
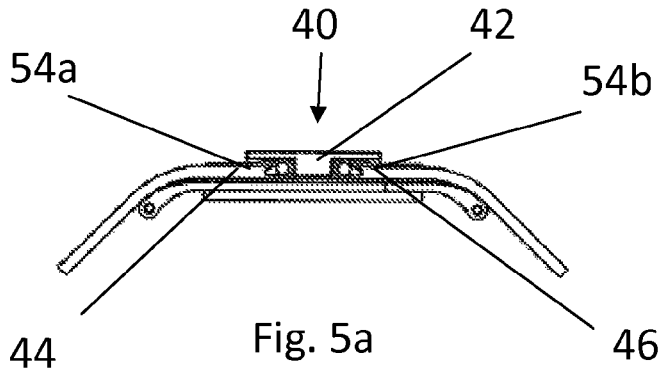
FIGS. 5*a*, 5*b*, 5*c* and 5*d* show longitudinal cross-sectional planar views according to the second embodiment.

In FIG. 5*a*, the two slides 44 and 46 are in their first extreme position. The latch 40 is locked. Each slide 44, 46 is essentially situated in each housing of the cap 42 so that the ends 54*a*, 54*b* of the latch are at a minimal distance.

Figure 5B:
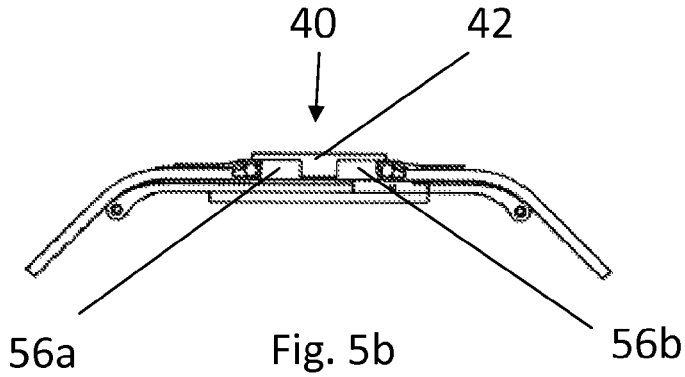

FIG. 5*b* shows the locked latch 40 in which each slide 44, 46 is partially extracted from its slide-way 56*a*, 56*b* such that the ends 54*a*, 54*b* of the latch are at a distance comprised between the minimum and maximum distances.

Figure 5C:
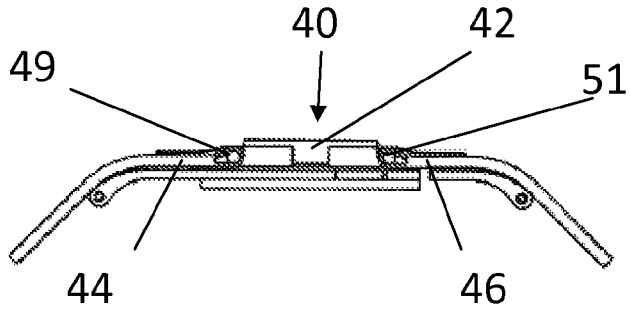
Figure 5D:
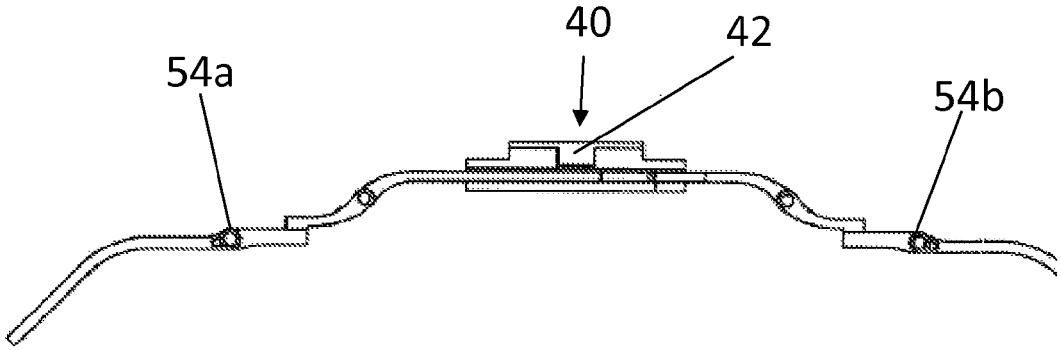

FIG. 5*c* shows the latch 40 unlocked. Each slide 44, 46 is in its second extreme position and is essentially situated outside the housing such that each first segment and each of the articulation means 49, 51 of the slide can be extended. This is the case in FIG. 5*d*, where the ends of the latch 54*a*, 54*b* are at a maximum distance whereas the buckle of the bracelet is extended.

The slides are therefore kept folded in the housings by the cap in all of the positions, except in their second respective extreme position.

In one advantageous embodiment, the slides are kinematically connected. They slide simultaneously, by a same distance increment, in opposite directions. One skilled in the art may refer to FIG. 6 to obtain a non-limiting example of one such embodiment. Each slide 72, 74 is provided with a rack 76, 78 positioned on the second segment. The racks 76, 78 are arranged to mesh with a pinion 80 rotatably mounted in the cap 82 of the latch.

Figure 7:
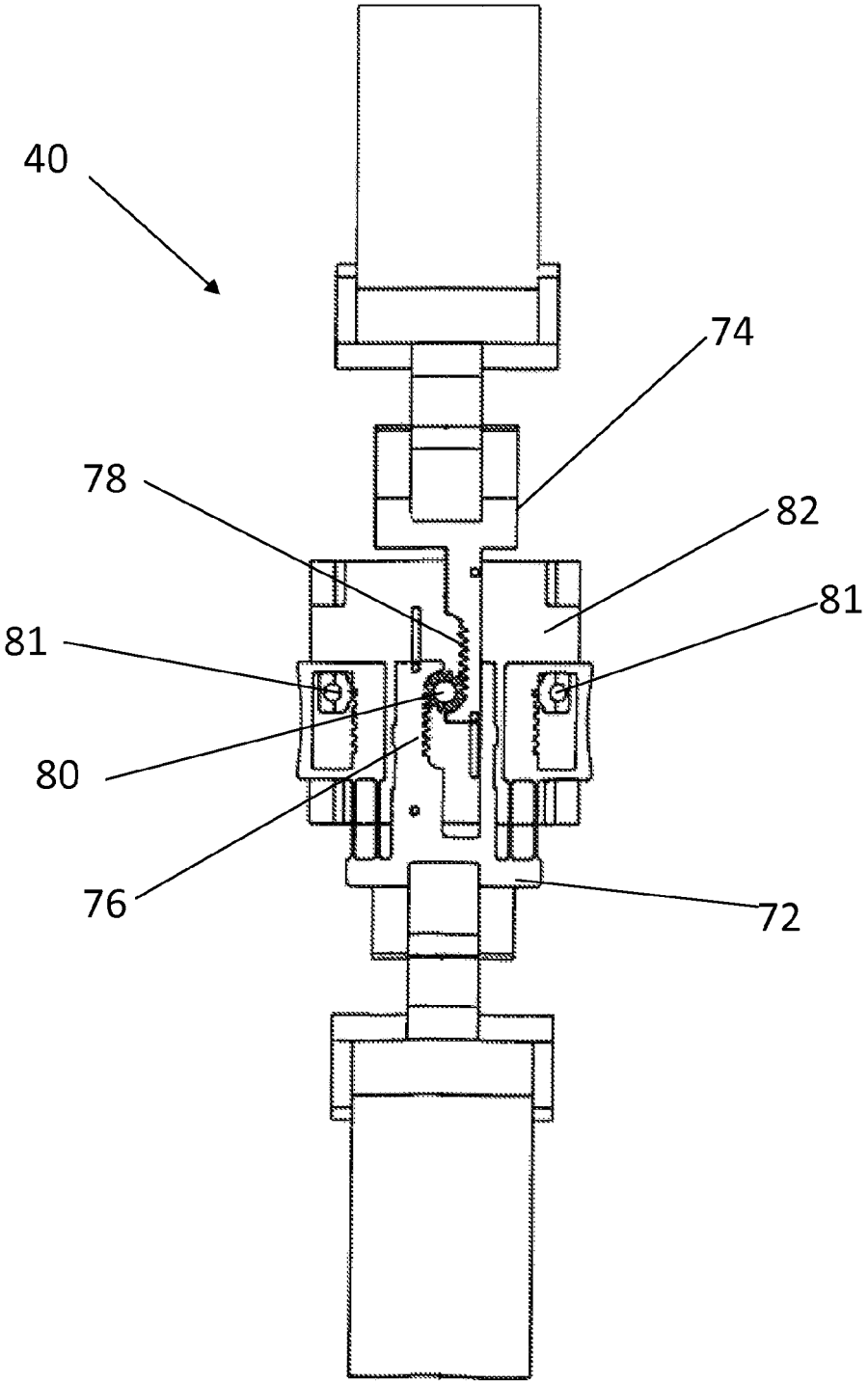
FIG. 7 is a top view of the second embodiment.

FIG. 7 shows a top view of a cutting plane of the latch in which the arrangement of the racks with the pinion is explained.

Figure 6:
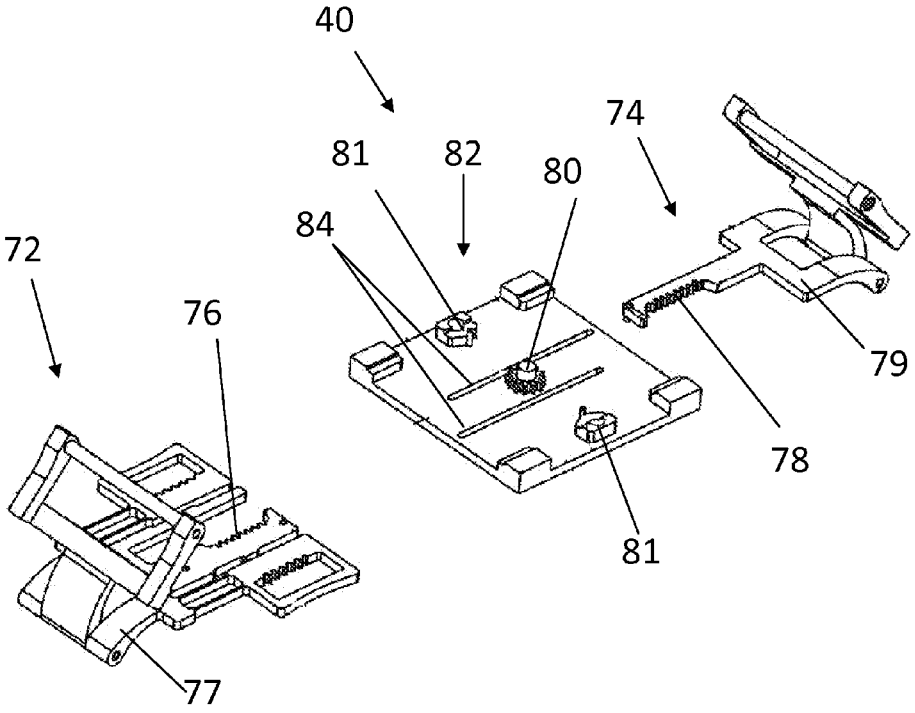
FIG. 6 is an exploded view of the latch according to the second embodiment.

FIGS. 6 and 7 also make it possible to illustrate the advantage of kinematically connecting the slides 72, 74. In fact, only a single slide needs to be provided with indexing means, which will perform that function for both slides, so as to adjust the length of the two strands of the bracelet simultaneously and lock/unlock the latch. In the case where two distinct indexing means are implemented, so as to improve the safety of the device, these two distinct indexing means can be on that same slide (as illustrated) or on the second.

Furthermore, a crown or a knurling-roller can advantageously be arranged on the cap 82 so as to drive the pinion and continuously adjust the length of the bracelet, compare the adjustment according to discrete positions of the bracelet defined by the notching of the latch. In that case, there is no longer a notching cooperating with an indexing finger. The maintenance device is replaced by sufficient friction exerted at the actuator or other means for blocking the crown or the knurling roller accessible to one skilled in the art, so as to allow sufficient locking of the latch. It is also possible to consider maintaining the pinion using a jumper spring or another suitable system, while providing for a disengageable connection of the crown and the pinion, through two edged toothings situated opposite one another and kept spaced apart by a spring. The user must stress that spring to engage the connection and rotate the pinion 80. Depending on the choice of construction, the stress may be exerted through traction or pressure. It is also possible to provide for locking the pinion using a click, which the user can actuate. The latter will have to release the pinion by actuating the click and turn the knurling roller at the same time.

Furthermore, the bottom of the cap 82 can also include a groove 84 arranged to guide the slides. To that end, the second segment can be provided with a lug cooperating with the groove, these elements forming an additional guide means. This also makes it possible to keep the rack engaged with the pinion over the entire travel of the slide.

The cap 82 can also be provided with an intermediate plate 11, visible in FIGS. 2 and 3, making it possible to divide the housing into two parts: a first, lower part in which the second segment 77, 79 of each slide slides, and an upper part in which the first segment of each slide slides. The intermediate plate in particular makes it possible to keep the lug of each second segment 77, 78 engaged in each groove 84 of the cap 82.

Thus proposed is a latch making it possible, through a simple action on either of the actuators, to easily modify the length of the bracelet to make it more comfortable without requiring that the watch be removed or that the bracelet be extended and the latch locked/unlocked to put the watch on the wrist or remove it therefrom. The actuators make it possible both to free the maintenance device so as to unblock the indexed position and to move the slide relative to the slide-way. The user must therefore exert a deliberate action on the actuator(s) to keep the maintenance device in a "free" position making it possible to move the slide and, at the same time, to exert a second deliberate action on the actuator(s) to move the slide. Optimal security is therefore procured. It will also be noted that all combinations are possible, for a latch of the butterfly type, for which only part of the latch is slidingly mounted relative to the cap.

The invention claimed is:

1. A bracelet latch with an extensible buckle comprising a cap defining a housing and having a first slide-way in which a first slide is engaged, the first slide being designed to be connected to a first strand of a bracelet by a first articulation means, the first slide includes at least first segment and second segment connected to one another by a second articulation means, said first segment and second segment being at least partially folded in the housing when the buckle of the bracelet latch is not extended, wherein said bracelet latch also comprises a first indexing means for indexing the first slide in the cap such that the first slide, relative to the cap, can occupy a series of indexed positions comprised between:

a first extreme position in which the first slide is situated in the housing such that ends of the bracelet latch are at a minimum distance, and a second extreme position where the first slide is partially situated outside the housing and where the first segment of the first slide is situated entirely outside the housing, said first slide being kept folded in the housing by the cap in all positions, except the second extreme position, only in which position can the first segment and second segment of the first slide be extended and the ends of the bracelet latch can be brought to a maximum distance, and wherein the first indexing means comprises a first actuator and a first maintenance device to block the different indexed positions, wherein said first actuator is arranged to transmit a force making it possible both to free the maintenance device so as to unblock an indexed position, and wherein said first actuator is further adapted to move the first slide longitudinally relative to the first slide-way.

2. The bracelet latch of claim 1, wherein the cap has a second slide-way arranged parallel to the first slide-way in which a second slide is arranged designed to connect the cap to a second strand of the bracelet by a third articulation means, wherein the second slide comprises at least a third segment and a fourth segment connected to one another by a fourth articulation means, said third segment and fourth segment being folded in said housing or in a second housing comprised by the cap, when the buckle of the bracelet latch is not extended, and wherein said bracelet latch also comprises a second indexing means for indexing the second slide in the cap such that the second slide, relative to the cap, can occupy a series of indexed positions comprised between:

a first extreme position in which the second slide is completely situated in the housing such that the ends of the bracelet latch are at a minimum distance, and a second extreme position where the second slide is situated partially outside the housing, said second slide being kept folded in the housing by the cap in all positions, except the second extreme position, in which at least one of the third segment and fourth segment and the third articulation means and the fourth articulation means of the second slide can extend and bring the ends of the bracelet latch to a maximum distance by extending the buckle of the bracelet.

3. The bracelet latch of claim 2, wherein the first maintenance device comprises an indexing finger and a notching capable of cooperating with the indexing finger, said indexed positions following one another discretely.

4. The bracelet latch of claim 3, wherein the first actuator is secured to the notching, said first actuator and said notching being elastically connected to a remainder of the first slide, and wherein the indexing finger is secured to the cap such that said indexing finger cooperates with said notching so as to block the first slide in the first slide-way when the first actuator is at rest.

5. The bracelet latch of claim 4, wherein the first actuator is a push button.

6. The bracelet latch of claim 3, wherein each of the first and second slide-ways comprise at least one groove designed to cooperate with a lug positioned on the respective slide to form an additional guide means.

7. The bracelet latch of claim 3, wherein each slide also comprises a rack arranged to mesh with a pinion rotatably mounted in the cap such that the first and second slides are kinematically connected and slide in opposite directions.

8. The bracelet latch of claim 1, wherein the cap comprises, in its housing, an intermediate plate arranged to be placed between the folded first and second segments of the first slide.

9. The bracelet latch of claim 1, wherein the first maintenance device comprises an indexing finger and a notching capable of cooperating with the indexing finger, said indexed positions following one another discretely.

* * * * *